US007366444B2

(12) United States Patent
Takane

(10) Patent No.: US 7,366,444 B2
(45) Date of Patent: Apr. 29, 2008

(54) TANDEM COLOR IMAGE FORMING APPARATUS INCLUDING A MONOCHROME PHOTOCONDUCTIVE MEMBER

(75) Inventor: Toshiaki Takane, Toyonaka (JP)

(73) Assignee: Ricoh Company Limited, Tokyo (JP)

( * ) Notice: Subject to any disclaimer, the term of this patent is extended or adjusted under 35 U.S.C. 154(b) by 137 days.

(21) Appl. No.: 11/253,695

(22) Filed: Oct. 20, 2005

(65) Prior Publication Data

US 2006/0088339 A1 Apr. 27, 2006

(30) Foreign Application Priority Data

Oct. 22, 2004 (JP) ..... 2004-308803

(51) Int. Cl.
*G03G 15/00* (2006.01)

(52) U.S. Cl. ..... 399/167; 399/301

(58) Field of Classification Search ..... 399/167, 399/301, 299, 306

See application file for complete search history.

(56) References Cited

U.S. PATENT DOCUMENTS 6,070,041 A * 5/2000 Nakayasu et al. ..... 399/301
6,693,654 B2 2/2004 Shinohara
6,711,364 B2 3/2004 Shinohara
2003/0137577 A1 7/2003 Shinohara

* cited by examiner

*Primary Examiner*—Quana Grainger
(74) *Attorney, Agent, or Firm*—Oblon, Spivak, McClelland, Maier & Neustadt, P.C.

(57) ABSTRACT

A color image forming apparatus includes a first detecting device that detects a first detection objective and generates a pulse signal having a prescribed voltage, and a second detecting device that detects the second detection objective and generates a pulse signal having the same width and a prescribed voltage. A time measuring device measures a time difference between a time when one of the first and second detecting devices firstly generates a pulse signal and a time when the other one of the first and second detecting devices firstly generates a pulse signal after measuring start. A phase calculation device calculates a difference in phase between the monochrome photoconductive member and mono color photoconductive member in accordance with the time difference. Driving speed of one of the first and second driving motors is controlled so that the phase difference decreases to a prescribed level.

5 Claims, 4 Drawing Sheets

FIG. 3

| No. | FIRSTLY SIGNAL GENERATING SENSOR & POTENTIAL CHANGE | SECONDLY SIGNAL GENERATING SENSOR & POTENTIAL CHANGE | MEASURED TIME | PHASE DIFFERENCE CALCULATED FROM MEASURED TIME | ADJUSTED PHASE DIFFERENCE |
|---|---|---|---|---|---|
| 1 | MONOCHROME USE SENSOR (H→L) | COLOR USE SENSOR (H→L) | 0.25 SECOND | +90° | +90° |
| 2 | MONOCHROME USE SENSOR (H→L) | COLOR USE SENSOR (L→H) | 0.25 SECOND | +90° | +90° +180° → +270° |
| 3 | COLOR USE SENSOR (H→L) | MONOCHROME USE SENSOR (H→L) | 0.125 SECOND | −45° | −45° → +315° |
| 4 | COLOR USE SENSOR (L→H) | MONOCHROME USE SENSOR (H→L) | 0.125 SECOND | −45° | +45° +180° → +135° |

TANDEM COLOR IMAGE FORMING APPARATUS INCLUDING A MONOCHROME PHOTOCONDUCTIVE MEMBER

CROSS REFERENCE TO RELATED APPLICATIONS

This application claims priority under 35 USC § 119 to Japanese Patent Application No. 2004-308803 filed on Oct. 22, 2004, the entire contents of which are herein incorporated by reference.

BACKGROUND OF THE INVENTION

1. Field of the Invention

The present invention relates to a tandem type color image forming apparatus that includes a laser driving device and a photoconductive member per each color.

2. Discussion of the Background Art

A conventional tandem type color image forming apparatus generally includes a plurality of image formation units arranged along a transfer belt that conveys a recording sheet so as to form and transfer a plurality of superimposing monochrome images at different image formation times.

Due to employment of the plurality of image formation units, a color image tends to deviate in such a tandem type color image forming apparatus.

Japanese Patent Application Laid Open No. 2000-28459 discusses a technology to reduce such color deviation even when phases of photoconductive drums change. Specifically, a plurality of registration marks having prescribed shapes are formed on a transfer belt by respective image formation units to be detected by an optical sensor. A positional deviation between the registration marks is calculated and updated based on the detection. A position to start writing the image (i.e., registration) is corrected in each color formation in accordance with positional deviation.

Further, Japanese Patent Application Laid Open No. 10-148992 discusses a technology capable of canceling color deviation caused by unevenness of a driving mechanism, such as belt traveling, photoconductive drum rotation, etc., by calculating an amount of correction for each color. Specifically, when the above-mentioned color correction technology is used and color deviation still remains, a plurality of registration patterns are repeatedly formed for each color over one cycle on the transfer belt and are detected by a photoelectric sensor.

Then, a color deviation is calculated over one cycle of the transfer belt. A representing value is obtained by averaging all of the color deviation amounts. A difference between the representing value and the color deviation amount is obtained and stored in a memory as a differential data with it being associated with the corresponding phase. When registration is practically performed, a small number of registration patterns are formed in a short interval between recording sheets on the transfer belt. Then, the registration patterns are detected and color deviation amounts are obtained. The color deviation amounts are corrected with reference to the differential amount of the same phase.

Since only a BK photoconductive member is used in a monochrome image formation mode of such a tandem type color image forming apparatus, phases of color photoconductive members generally need to be the same to the phase of the BK photoconductive member, when the monochrome image formation mode is changed to a color image formation mode.

SUMMARY OF THE INVENTION

Accordingly, an object of the present invention is to address and resolve the above and other problems and provide a new tandem type image forming apparatus. The above and other objects are achieved according to the present invention by providing a novel tandem color image forming apparatus including a monochrome photoconductive member that bears a monochrome image, which is driven by a first driving motor, and a plurality of mono color photoconductive members each bears a different mono color image, which is driven by a second driving motor a first detection objective is attached to the monochrome photoconductive member, while a second detection objective attached to one of the plurality of mono color photoconductive members.

In one embodiment, a first detecting device is provided to detect the first detection objective and generates a pulse signal having a prescribed voltage. A second detecting device is provided to detect the second detection objective and generates a pulse signal having a prescribed voltage. The pulse has the same width to that generated by the first detecting device. A time measuring device is provided to measure a time difference between a time when one of the first and second detecting devices firstly generates a pulse signal and a time when the other one of the first and second detecting devices firstly generates a pulse signal after measuring start. A phase calculation device is provided to calculate a difference in phase between the monochrome photoconductive member and mono color photoconductive member in accordance with the time difference. A control device is provided to control driving speed of the first and/or second driving motors so that the phase difference decreases to a prescribed level.

In another embodiment, the first and second detecting devices start detecting before image formation is started and said first and second driving motor reach a prescribed constant rotational speed.

In yet another embodiment, the first and second detecting devices start detecting during image formation.

In yet another embodiment, a setting device is provided to set the prescribed level.

In yet another embodiment, the fist and second detection objectives include a half-moon shaped filler.

In yet another embodiment, the phase calculation device adjusts calculation result by either adding or subtracting 180 degree when polarities of the pulse signals generated by the first and second detecting device are different.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein:

FIG. 3 illustrates an exemplary phase calculation result obtained from a change in voltage of a sensor and a time period.

PREFERRED EMBODIMENTS OF THE PRESENT INVENTION

Figure 1:
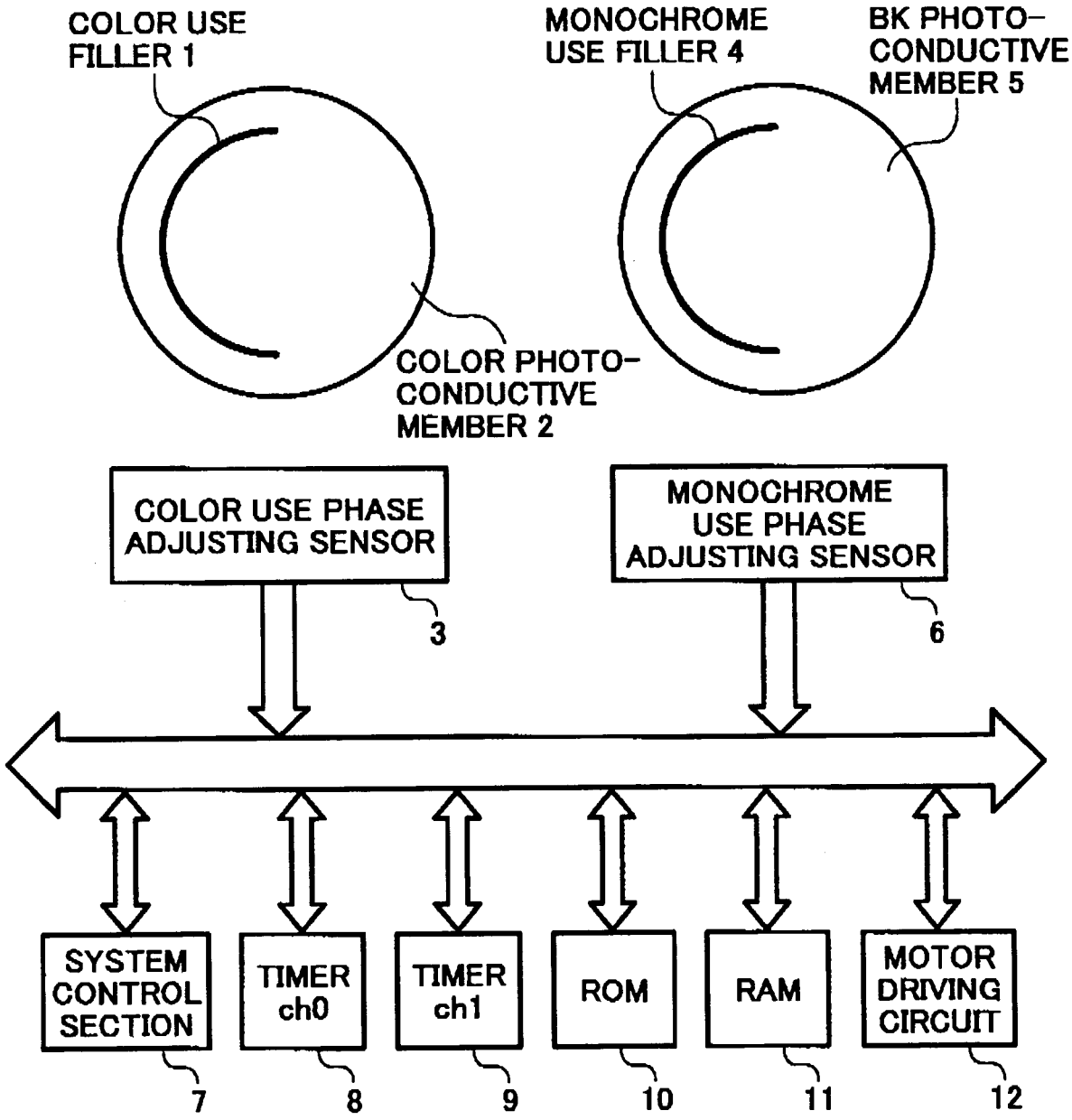
FIG. 1 illustrates an exemplary color image forming apparatus according to one embodiment of the present invention.

Referring now to the drawings, wherein like reference numerals and marks designate identical or corresponding parts throughout several views, in particular in FIG. 1, an exemplary color image forming apparatus is illustrated. As shown, the color image forming apparatus includes a color use filler 1, a color photoconductive member 2, a color use phase adjustment sensor 3, a monochrome use filler 4, a BK photoconductive member 5, a monochrome use phase adjustment sensor 6, a system control section 7, a ch0 timer 8, a ch1 timer 9, a ROM (Read Only Memory) 10, a RAM (Random Access Memory) 11, and a motor driving circuit 12.

The color and monochrome use fillers 1 and 4 are made of plastic, rubber, and relatively inert material added to paint, to improve intensity and a function at low cost.

The color and black photoconductive members 2 and 5 are drum or film type, and are positively or negatively charged to lose electricity at a portion exposed to a light.

The system control section 7 executes phase adjustment control.

The ch0 timer 8 times from when a counter thereof is reset to when a monochrome use phase adjustment sensor 6 generates and inputs a signal indicative of detection of the filler 5 to the system control section 7, while the ch1 timer 9 times from when a counter thereof is reset to when the color use phase adjustment sensor 3 generates and inputs a signal indicative of detection of the filler 1 to the system control section 7. Thus, the timer provides two channels.

The ROM 10 is a digital memory that does not lose storage contents even if power supply is turn off.

The RAM 11 is a semiconductor (IC) that allows free and high speed reading from every location and writing and storing new data, such as phase differential data, etc., in optional locations.

The motor driving circuit 12 controls motors to drive the BK and color photoconductive members 5 and 2.

In the non-limited embodiment, respective photoconductive members of yellow, magenta, and cyan are synchronously driven at the same phase to each other, because they are used only in a color image formation mode.

The color use filler 11 is attached to a section of any one of the yellow, magenta, and cyan photoconductive members 2, and is detected by the color use phase adjustment sensor 3. The monochrome use filler 4 is attached to a section of the black photoconductive member 5, and is detected by the monochrome use phase adjustment sensor 6.

Figure 2A:
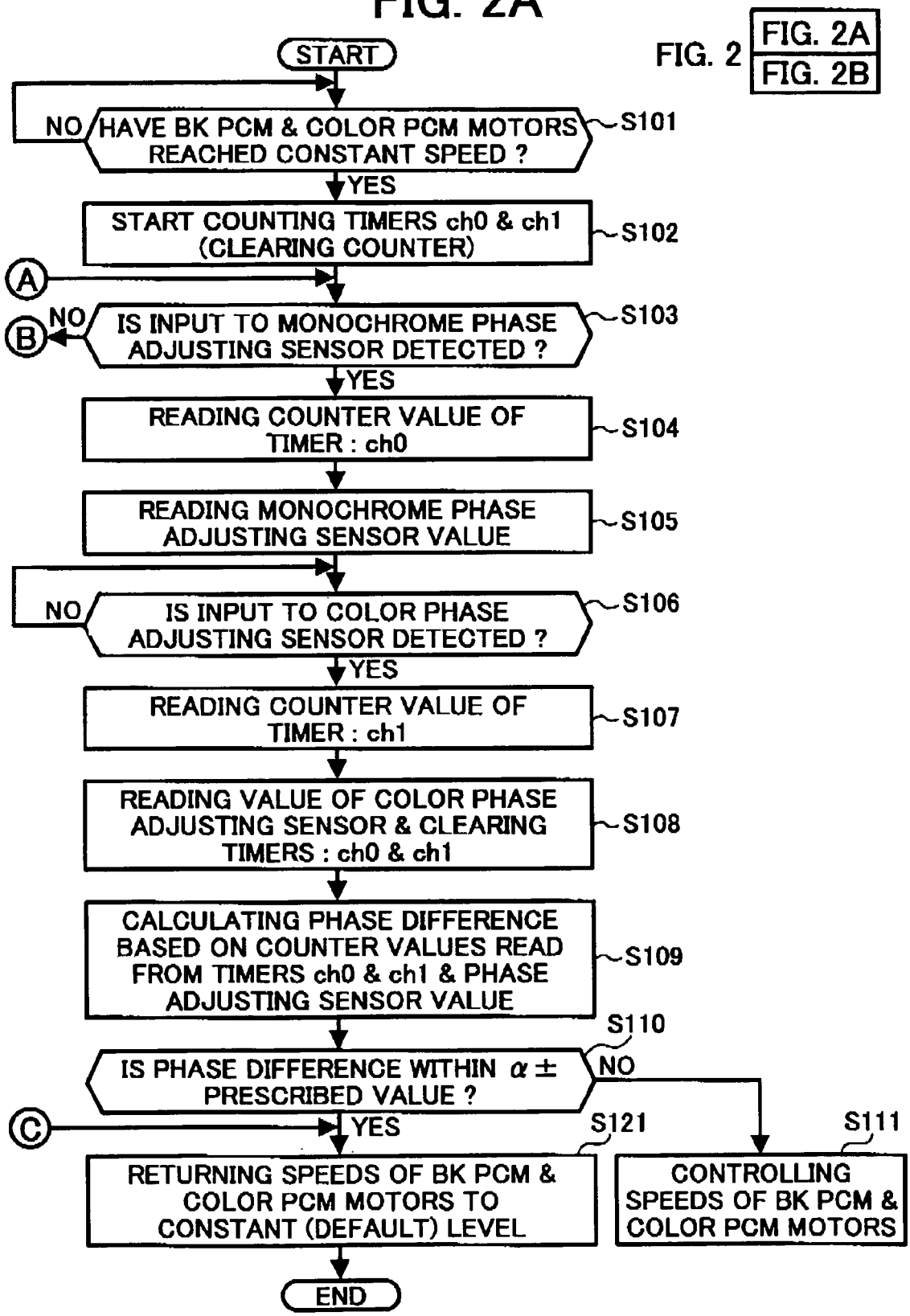
FIGS. 2A and 2B collectively illustrate an exemplary operational sequence of the color image forming apparatus according to one embodiment of the present invention.
Figure 2B:
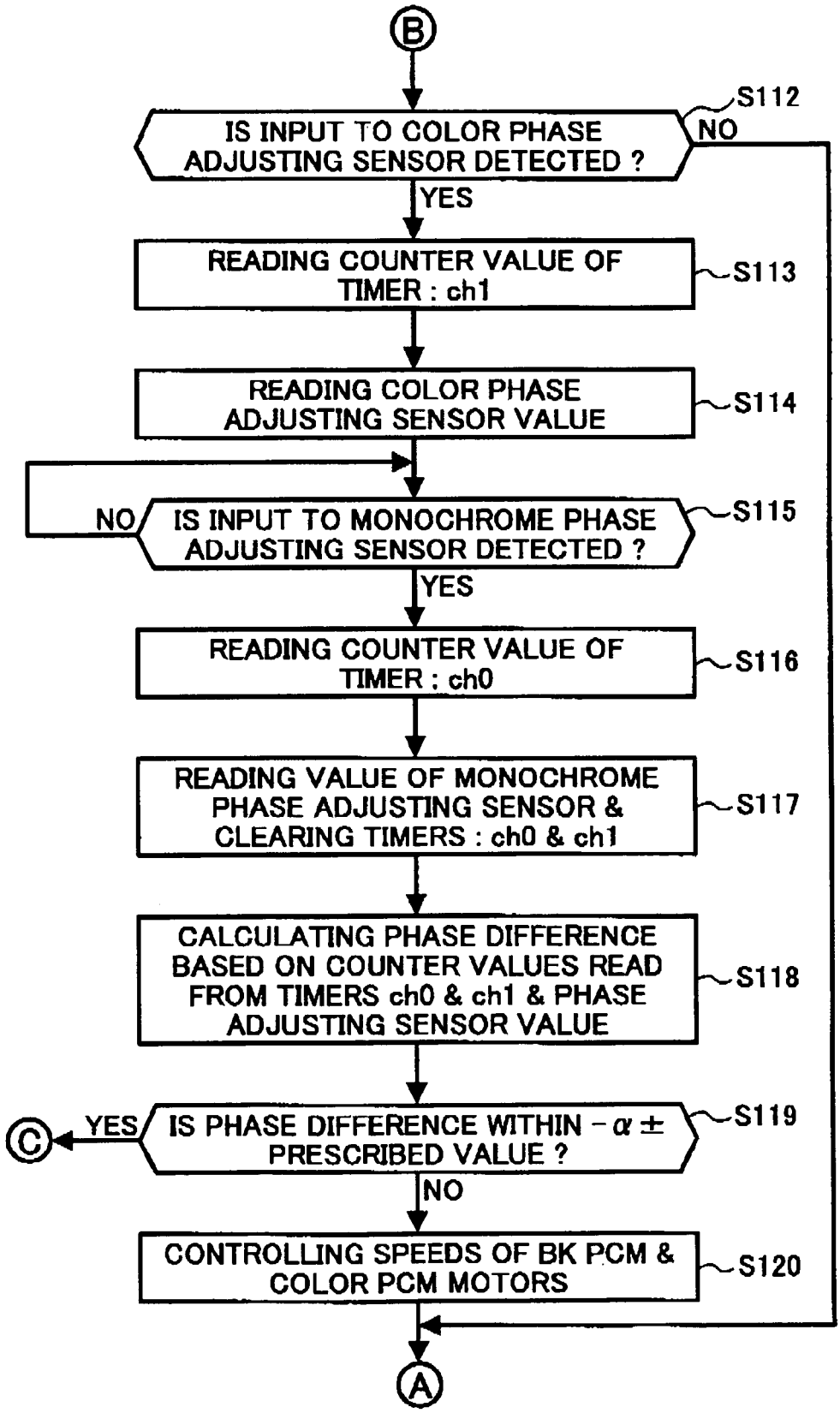

Now, an exemplary sequence of adjusting respective phases of color and monochrome photoconductive members is described with reference to FIG. 2.

Initially, it is determined if the motors of the BK and color photoconductive members 5 and 2 reach a prescribed constant speed in step S101. If the determination is positive (i.e., Yes, in step S101), the counters of the ch0 and ch1 timers 8 and 9 are reset, and simultaneously start timing in step S102. If the determination is negative (No, in step S101), the sequence returns to the first step.

It is then determined if the monochrome use phase adjustment sensor 6 generates and inputs a signal indicative of detection of the filler 4 to the system control section 7 in step S103. If the determination is positive (i.e., Yes, in step S103), a value (e.g. a time) of the counter of the ch0 timer 8 and a value (e.g. a high or low voltage level) of the monochrome use phase adjustment sensor 6 are read in steps S104 and S105. If the determination is negative (No, in step S103), the sequence goes to a step of detecting an input of a signal from the color use phase adjustment sensor.

It is then determined if the system control section 7 receives a detection signal input from the color use phase adjustment sensor 3 in step S106. If the determination is positive (i.e., Yes, in step S106), a counter value (e.g. a time) of the ch1 timer 9 and a value (e.g. a high or low voltage level) of the color use phase adjustment sensor 3 are read in steps S107 and S108. These values of the ch0 and ch1 timers 8 and 9 are simultaneously reset. A phase difference is then calculated based on the counter values read from the ch0 and ch1 timers 8 and 9, and the values of the phase adjustment sensors 3 and 6 in step S109 as shown in FIG. 3. If the determination is negative (No, in step S106), the sequence is repeated until an input of a detection signal is detected. Since the monochrome and color phase adjustment fillers employ half moon shaped fillers, a phase difference is detected twice per rotation of the photoconductive member, because phases of monochrome use and color use phase adjustment sensors are recognized once per 180 degree. When the value of the monochrome phase adjustment sensor is different from that of the color phase adjustment sensor, for example, high and low or low and high, it is supposed that the deviation therebetween amounts to more than 180-degree. Thus, 180-degree is added or subtracted from the time based measurement result of the phase difference as shown by second and fourth examples in FIG. 3.

It is then determined if the phase difference is within a prescribed value (e.g. $\alpha \pm \beta$) in step S110. If the determination is positive (i.e., Yes, in step S110), the motors of the BK and color photoconductive members 5 and 2 are returned to an image formation speed, and the sequence is terminated in step S121. If the determination is negative (i.e., No, in step S110), speeds of the motors of the BK and/or color photoconductive members 5 and 2 are adjusted by executing the above-mentioned phase adjustment control again so that the phase difference falls within the prescribed level in step S111. The above-mentioned value $\alpha$ represents a time period from when the monochrome use phase adjustment sensor 6 generates and inputs a detection signal to when the color use phase adjustment sensor generates and inputs a detection signal. Thus, the phase difference is controlled to be $\alpha$ based on the signal form the monochrome use phase adjustment sensor 6 when the monochrome use phase adjustment sensor 6 generates and inputs a detection signal earlier than the color use phase adjustment sensor 3.

Further, a phase difference between the BK and the other photoconductive members can be controlled by optionally setting the $\alpha$ so as to suppress color deviation to the least. Further, an optimum phase difference $\alpha$ can be set in accordance with a machine.

Back to step S103, when the color use phase adjustment sensor 3 generates and inputs a detection signal earlier than the monochrome use phase adjustment sensor 6 (No, in step S112), a counter value of the ch1 timer 9 and a value of the color use phase adjustment sensor 3 are read (in steps S113 and S114).

It is then determined if the monochrome use phase adjustment sensor 6 generates and inputs a detection signal in step S115. If the determination is positive (i.e., Yes, in step S115), a counter value of the ch0 timer 8 and a value of the monochrome use phase adjustment sensor 6 are read (in steps S116 and S117). These values of the counters of the ch0 and ch1 timers 8 and 9 are simultaneously reset. A phase difference is then calculated based on the counter values read from the ch0 and ch1 timers 8 and 9, and the value of the phase adjustment sensor (in step S118) as mentioned earlier.

If the determination is negative (No, in step S115), the sequence is repeated until the detection signal input is detected. When the value of the monochrome phase adjustment sensor is different from that of the color phase adjustment sensor, it is supposed that the deviation amounts to more than 180 degree. Thus, 180 degree is finally added or subtracted from a time based measurement result of a phase difference as shown in third example of FIG. 3.

It is then determined if the phase difference ranges within a prescribed value (e.g. $-\alpha\pm\beta$) in step S119. If the determination is positive (i.e., Yes, in step S119), the motors of the BK and color photoconductive members 5 and 2 return to an image formation speed (in step S121), and the sequence is terminated. If the determination is negative (i.e., No, in step S119), respective speeds of the motors of the BK and color photoconductive members 5 and 2 are adjusted by executing the above-mentioned phase adjustment control again so that the phase difference falls within the prescribed level (in step S120) Thus, the phase difference is controlled to be $-\alpha$ based on the signal from the color use phase adjustment sensor 3 when the color use phase adjustment sensor generates and inputs a detection signal earlier than the monochrome use phase adjustment sensor 6.

An interruption system can be employed to interrupt an image forming operation and quickly execute the above-mentioned phase deviation control when one of the monochrome use phase adjustment sensor 6 and the color use phase adjustment sensor 3 generates and inputs the detection signal.

Numerous additional modifications and variations of the present invention are possible in light of the above teachings. It is therefore to be understood that within the scope of the appended claims, the present invention may be practiced otherwise that as specifically described herein.

What is claimed is:

1. A tandem color image forming apparatus, comprising:

a monochrome photoconductive member configured to bear a monochrome image, said monochrome photoconductive member configured to be driven by a first driving motor;

at least one mono color photoconductive member configured to bear a mono color image, said at least one mono color photoconductive member configured to be driven by a second driving motor;

a first detection objective attached to the monochrome photoconductive member;

a second detection objective attached to the at least one mono color photoconductive member;

a first detecting device configured to detect the first detection objective and generate a first pulse signal having a prescribed voltage;

a second detecting device configured to detect the second detection objective and generate a second pulse signal having a prescribed voltage, said second pulse signal having a same width as the first pulse signal generated by the first detecting device;

a time measuring device configured to measure a time difference between a time when one of the first and second detecting devices firstly generates either said first pulse signal or said second pulse signal, respectively, and a time when the other one of the first and second detecting devices firstly generates said second pulse signal or said first pulse signal, respectively, after measuring start;

a phase calculation device configured to calculate a difference in phase between the monochrome photoconductive member and the at least one mono color photoconductive member in accordance with the time difference; and a control device configured to a control driving speed of at least one of the first and second driving motors so that the phase difference decreases to a prescribed level, wherein said first and second detecting devices are configured to start detecting during image formation.

2. A tandem color image forming apparatus, comprising:

a monochrome photoconductive member configured to bear a monochrome image, said monochrome photoconductive member configured to be driven by a first driving motor;

at least one mono color photoconductive member configured to bear a mono color image, said at least one mono color photoconductive member configured to be driven by a second driving motor;

a first detection objective attached to the monochrome photoconductive member;

a second detection objective attached to the at least one mono color photoconductive member;

a first detecting device configured to detect the first detection objective and generate a first pulse signal having a prescribed voltage;

a second detecting device configured to detect the second detection objective and generate a second pulse signal having a prescribed voltage, said second pulse having a same width as the first phase signal generated by the first detecting device;

a time measuring device configured to measure a time difference between a time when one of the first and second detecting devices firstly generates either said first pulse signal or said second pulse signal, respectively, and a time when the other one of the first and second detecting devices firstly generates said second pulse signal or said first pulse signal, respectively, after measuring start;

a phase calculation device configured to calculate a difference in phase between the monochrome photoconductive member and the at least one mono color photoconductive member in accordance with the time difference; and a control device configured to control a driving speed of at least one of the first and second driving motors so that the phase difference decreases to a prescribed level, wherein said first and second detecting devices are configured to start detecting before image formation is started and said first and second driving motor reach a prescribed constant rotational speed, and said fist and second detection objectives include a half-moon shaped filler.

3. The tandem color image forming apparatus as claimed in claim 2, wherein said phase calculation device is configured to adjust calculation result by either adding or subtracting 180 degrees when polarities of the first and second pulse signals generated by the first and second detecting device are different.

4. A method, comprising driving a monochrome photoconductive member bearing a monochrome image with a first driving member;

driving at least one mono color photoconductive member bearing a mono color image with a second driving member;

detecting a first detection objective attached to the monochrome photoconductive member and generating a first pulse signal having a prescribed voltage;

detecting a second detection objective attached to the at least one mono color photoconductive member and generating a second pulse signal having a prescribed voltage, the second pulse signal having a same width as the first pulse signal;

measuring a time difference between a time when the first pulse signal is generated and a time when the second pulse signal is generated;

calculating a difference in phase between the monochrome photoconductive member and the at least one mono color photoconductive member in accordance with the time difference; and controlling a driving speed of at least one of the first and second driving motors so that the phase difference decreases to a prescribed level, wherein said detecting the first detection objective and said detecting the second detection objective are implemented during image formation.

5. The method of claim 4, wherein said calculating a difference in phase includes adjusting a calculation result by either adding or subtracting 180 degrees when polarities of the first and second pulse signals are different.

* * * * *